US006005882A

United States Patent [19]

Hyde, Jr.

[11] Patent Number: 6,005,882

[45] Date of Patent: Dec. 21, 1999

[54] ELECTRON PUMP

[76] Inventor: James R. Hyde, Jr., 11361 E. Wilson Rd., Otisville, Mich. 48463

[21] Appl. No.: 08/972,194

[22] Filed: Nov. 18, 1997

[51] Int. Cl.[6] ..... H01J 40/02

[52] U.S. Cl. ..... 372/74; 250/493.1; 250/503.1; 313/523; 313/544

[58] Field of Search ..... 372/69, 70, 73, 372/74, 109, 2; 250/493.1, 496.1, 503.1, 492.2; 313/523, 524, 537, 539, 541, 542, 544

[56] References Cited

U.S. PATENT DOCUMENTS

| | | | |
|---|---|---|---|
| 3,972,009 | 7/1976 | Duchet | 372/74 |
| 4,460,831 | 7/1984 | Oettinger et al. | 250/492.2 |
| 4,554,458 | 11/1985 | Behringer et al. | 250/492.2 |
| 4,649,547 | 3/1987 | Carlson et al. | 372/61 |
| 4,715,039 | 12/1987 | Miller et al. | 372/37 |
| 4,820,927 | 4/1989 | Langner et al. | 250/492.2 |
| 4,897,851 | 1/1990 | Vecht et al. | 372/107 |
| 4,906,894 | 3/1990 | Miyawaki et al. | 313/542 |
| 4,910,742 | 3/1990 | Meinhardt | 372/37 |
| 4,970,392 | 11/1990 | Oettinger et al. | 313/542 X |
| 5,136,212 | 8/1992 | Eguchi et al. | 315/150 |
| 5,142,193 | 8/1992 | Chang et al. | 313/542 |
| 5,222,073 | 6/1993 | Epstein et al. | 372/34 |
| 5,335,238 | 8/1994 | Bahns | 372/37 |
| 5,684,360 | 11/1997 | Baum et al. | 313/542 |

*Primary Examiner*—John D. Lee
*Attorney, Agent, or Firm*—Weintraub & Brady, P.C.

[57] ABSTRACT

An electron pump organized along the lines of a laser device has an interior chamber with a quartz crystal axially disposed around a metallic rod. The rod and crystal are surrounded by flash lamps, which stimulate the electrons therein to produce an electron flow. A heat exchanger surrounds the interior chamber. An outer chamber surrounding the heat exchanger has wire windings therein to produce an electric field to direct the electron flow. Carbon brushes convert the electron flow into electric current.

3 Claims, 1 Drawing Sheet

FIG 1
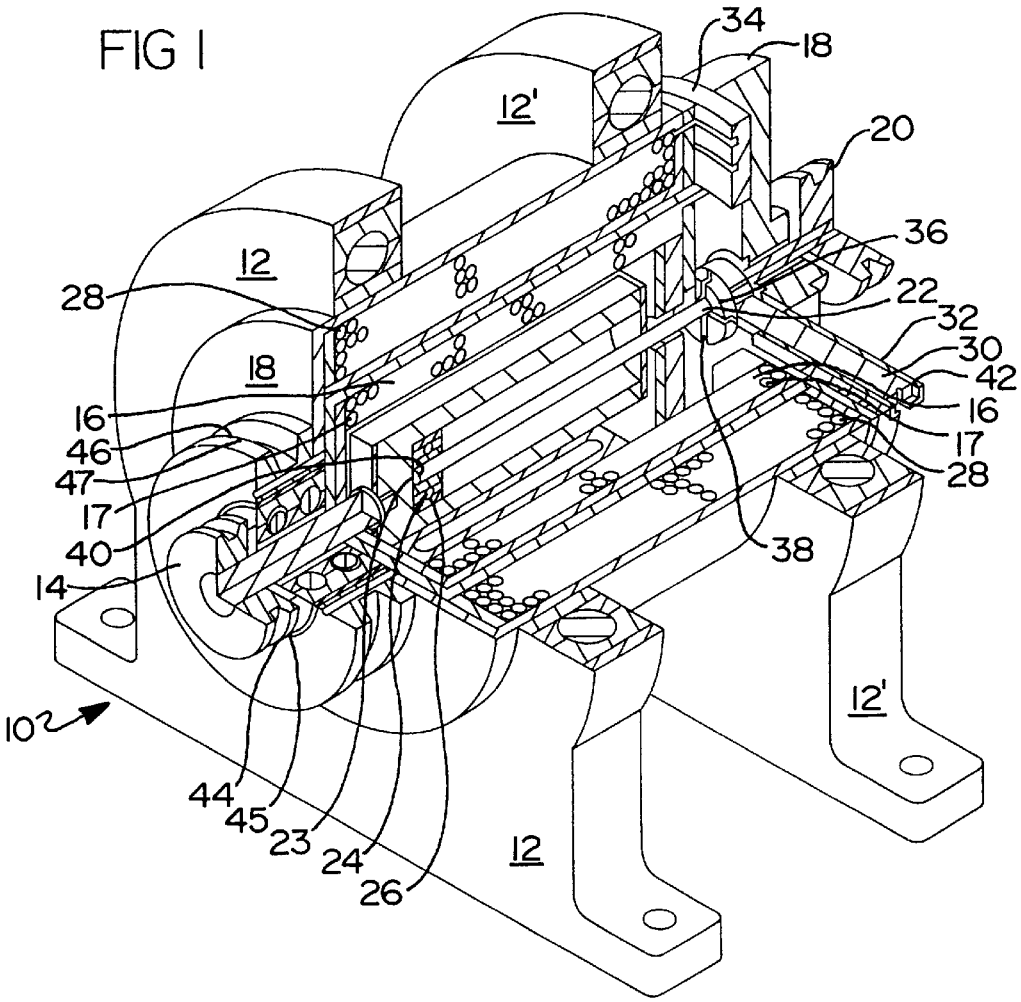
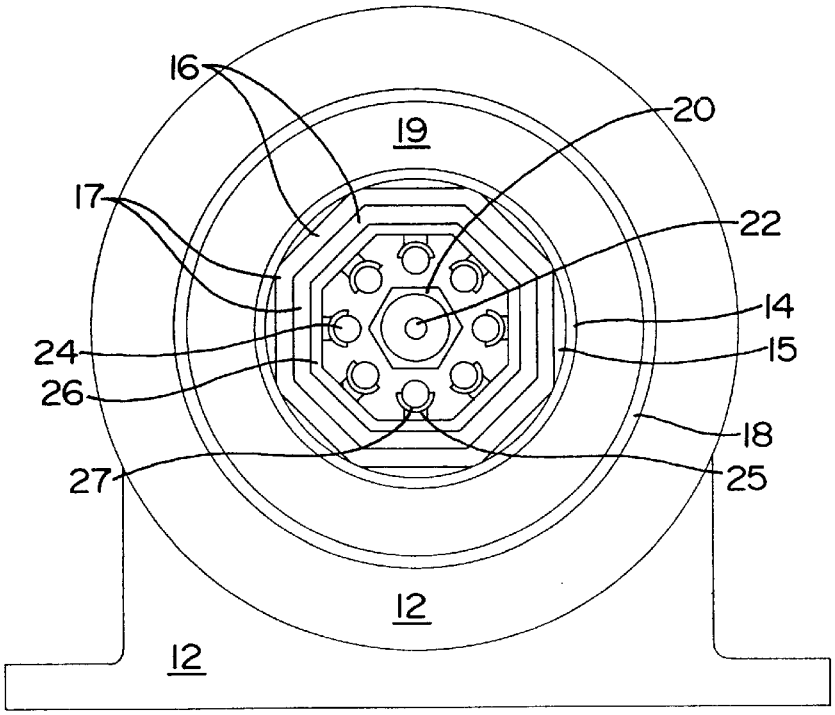
FIG 2

ELECTRON PUMP

BACKGROUND OF THE INVENTION

I. Field of the Invention

The present invention relates to electron pumps. More particularly, the present invention concerns a device to produce an electric flow from electrons freed from a quartz crystal.

II. Prior Art

The emission of electrons, particularly as a beam of radiation, is known by the term "light amplification by simulated emission of radiation," commonly referred to as a "laser." The related "microwave amplification by simulated emission of radiation" is commonly referred to as a "maser." Briefly, such devices achieve the desired end by pumping, excitation, and emission processes occurring at fast speeds. Electrons are raised from a close orbit to an outer orbit by pumping or radiation. This results in an excess of electrons in the outer orbit. Under excitement, some of these excess electrons flow to a middle orbit. From the middle orbit, the electrons fill in the openings created by the radiation. In falling into the closest orbit, there is an emission of radiation. This emission is the beam noted with these devices.

This general principle has been embodied in several applications and improvements. One device is found in U.S. Pat. No. 5,222,073, issued Jun. 22, 1993 to Epstein et al. and entitled "ROD LASERS." Epstein et al. teach a neodymium glass rod being excited by flash lamps. The radiation emission therefrom produces the laser beam. Flowing fluid is used in coiled tubes around the rod to keep the temperatures below the threshold for stress fractures to occur. Temperature monitoring prevents continued operation beyond the means to regulate the temperature.

Other devices are legion, giving various advances and innovations from water cooled laser systems in U.S. Pat. No. 4,715,039 to heat webs used in U.S. Pat. No. 4,649,547. What is lacking in the art is means to use the excitation cycle of the laser and maser devices to produce an electrically usable current for industrial or other use. It is to this end that the present invention is directed.

SUMMARY OF THE INVENTION

The present invention is an electron pump comprising:

(a) an inner housing formed of a metallic alloy, the inner housing having an inner chamber therein, the inner chamber having therein:
  (1) a metallic rod centrally disposed therein;
  (2) a quartz crystal axially disposed around the rod, an electron flow being generated from the crystal;
  (3) a plurality of flash lamps disposed around the crystal; and
  (4) a plurality of reflectors surrounding the lamps;

(b) means for cooling surrounding the inner housing;

(c) an outer housing disposed around the means for cooling, the outer housing having an outer chamber therein, the outer chamber having coiled wire windings therein; and (d) a plurality of carbon brushes disposed proximate one end of the metallic rod, the brushes receiving the electron flow and creating an electric current therefrom.

The present invention is an electron pump that improves upon traditional laser technology by generating an electric current therefrom.

The pump comprises a pair of mounts; a first or inner housing surrounding a first or inner chamber; means for cooling surrounding the inner housing; a second or outer housing surrounding a second or outer chamber, the means for cooling and the inner housing disposed within the outer chamber; and a plurality of coiled wire windings disposed around the means for cooling within the outer chamber. The outer housing contacts and rests upon the mounts.

The inner housing contains a metallic rod and a quartz crystal axially disposed therearound. One end of the metallic rod engages a computator. A plurality of flash lamps surrounding the quartz crystal, and a plurality of reflectors surrounding the flash lamps, pump the electron level in the quartz crystal. The means for cooling cools the inner chamber and the elements therein, which is needed because the temperature rises quickly during the pumping process.

The outer chamber contains a plurality of electrically conductive wire windings surrounding the means for cooling. A stator in the outer chamber provides electric current to the wire windings.

In use, the outer housing, and thus the wire windings, rotate in a first direction, and the metallic rod and the computator rotate in a second direction opposite to the first direction. In conjunction with the pumping action in the quartz crystal generated by the flash lamps and the reflectors, this bi-directional rotation generates an electron flow into the computator. The electron flow goes from the computator into a plurality of carbon brushes that abut the computator. An electric current leaves the carbon brushes via at least one wire. Thus, the pump generates an electric current.

The present invention will be more clearly understood with reference to the accompanying drawings and the following detailed description, in which like reference numerals refer to like parts and in which:

BRIEF DESCRIPTION OF THE DRAWINGS

FIG. 1 is a perspective view of the electron pump of the present invention; and FIG. 2 is a cross-sectional side view of the quartz crystal of the electron pump of the present invention.

DETAILED DESCRIPTION OF THE PREFERRED EMBODIMENT

Referring now to FIGS. 1 and 2, there is seen therein an electron pump 10 of the present invention. The pump 10 comprises a pair of mounts 12, 12'; a first or inner housing 14 surrounding a first or inner chamber 15; means for cooling 16 surrounding the inner housing 14; a second or outer housing 18 surrounding a second or outer chamber 19, the means for cooling 16 and the inner housing 14 disposed within the outer chamber 19; and a plurality of coiled wire windings 28 disposed around the means for cooling 16 within the outer chamber 19. The outer housing 18 contacts and rests upon the mounts 12, 12'.

The inner housing 14 is formed of iron or other suitable metal, for example titanium, vanadium, zirconium, nickel, chromium, manganese, magnesium, or an alloy of iron, which acts as a shield to prevent electron escape from the chamber.

Disposed within the inner chamber 15 is a reflective housing 25 that holds other elements, as discussed hereinbelow. The reflective housing 25 is molded from glass, such as the well-known Pyrex brand, or a similar material. The reflective housing 25 contains a bearing housing 23 and a plurality of seats 27 molded therein. The bearing housing 23 contains a bearing (not shown).

A metallic rod 22 is mounted to the bearing in the bearing housing 23 that is molded into the reflective housing 25. The rod 22 is essentially cylindrical and runs the length of the inner chamber 15. The rod 22 has at least one longitudinal copper insert 40 embedded therein. The rod 22 is used in generating an electron flow, as discussed hereinbelow.

One end of the rod 22 is attached to a computator 36. The computator 36 has at least one radial copper insert 38 embedded therein. The at least one copper insert 38 of the computator 36 is in electric communication with the at least one copper insert 40 of the metallic rod 22. The computator 36 is seated in the inner housing 14. The computator 36 is used in generating an electron flow, as discussed hereinbelow.

A toroidal quartz crystal 20 is axially disposed around the metallic rod 22 within the inner chamber 15. The quartz crystal 20, when heated, gives off ultraviolet light.

A plurality of flash lamps 24 surrounds the crystal 20. Each flash lamp 24 is seated in a seat 27 molded into the reflective housing 25. The lamps 24 are standard xenon tubes, as are commonly known and available. The flash lamps 24 are powered via wires (not shown) that project through the Pyrex reflective housing 25. The wires (not shown) go into a standard flash power source (not shown) comprising a battery and a capacitor, as is well-known in the laser art. The flash lamps 24 are used in achieving a pumping action, as discussed hereinbelow.

A plurality of reflectors 26 surrounds the lamps 24, as is commonly known in similar devices. The reflectors 26 are molded into the reflective housing 25. The lamps 24 and reflectors 26 operate to achieve a pumping action and raise the electron levels in the quartz crystal 20. This raising of the electron levels is achieved as follows: When the flash lamps 24 flash, thus raising the potential energy level, this generates pressure, light waves, and heat. These stimulate the quartz crystal 20 and the surrounding air, as well as the other lamps 24. This technique is well-known in the laser art.

The means for cooling 16 comprises cooling tubes 17 that are axially disposed around the inner housing 14, thus surrounding the inner chamber 15. The cooling tubes 17 are formed of glass, such as the well-known Pyrex brand, and are disposed around the reflectors 26 by heating the tubes 17 until they are pliable and then winding them around the reflectors 26. The cooling tubes 17 serve to reduce the temperature of the inner chamber 15, whose temperature increases quickly during the excitation and emission processes. The cooling tubes 17 are filled with fluid such as liquid water, glycol, liquid nitrogen, air or the like, and reduce the temperature of the inner chamber 15 by absorbing heat from the inner chamber 15 through the glass of the cooling tubes 17. As is well known, heat will travel from a hotter area, such as the inner chamber 15, to a cooler area, such as the fluid inside the cooling tubes 17. Alternatively, instead of cooling tubes 17, another form of heat exchanger (not shown) may be used to cool the inner chamber 15.

The outer chamber 19 has coiled wire windings 28 therein. The wire windings 28 are made of copper, silver, or another conductive metal. The purpose of the wire windings 28 is to establish an electric field. One purpose of this field is to keep focused the emission of electrons in the interior chamber 14; another purpose of this field is to establish a piezoelectric pulse in the electron flow of the interior chamber 14. The piezoelectric pulse is proportional to the rotation of the wire windings 28.

A stator 34 is disposed within the outer chamber 19. The stator 34 provides electric current to the wire windings 28 to establish the electric field.

Carbon brushes 30 are deployed at one end of the pump 10. The brushes 30 are surrounded by a metal casing 32. The metal casing 32 is attached to the outer housing 18 by spot welding or the like, and is disposed such that the carbon brushes 30 abut the computator 36. The brushes 30 receive the electron flow from the interior chamber 14 by the following method.

The metallic rod 22 and the computator 36 rotate in a first direction via belts 45 surrounding pulleys 44 surrounding the inner housing 14. Concurrently, the outer housing 18, including the wire windings 28 therein, rotates in a second direction opposite to the first direction via belts 47 surrounding pulleys 46 surrounding the outer housing 18. The belts 45 and 47 are driven by motors (not shown) via suitable rotatable motor output shafts to which the belts are connected (not shown). Concurrently with this bi-directional rotation, the flash lamps 24 and the reflectors 26 create the pumping action described hereinabove in the quartz crystal 20. The bi-directional rotation, in conjunction with the pumping action, creates an electron flow through the copper inserts 40 in the metallic rod 22 and into the metallic inserts 38 in the commutator 36. From the computator 36, the electron flow enters the carbon brushes 30, which abut the computator 36 as described hereinabove.

At least one wire 42 projects from the carbon brushes 30. The electron flow that enters the carbon brushes 30 from the computator 36 leaves the carbon brushes 30 through the at least one wire 42. Utilizing this technique, an electric current can be drawn from the pump 10 through the at least one wire 42.

While the invention has been illustrated and described in detail in the drawings and the foregoing description, the same is to be considered as illustrative and not restrictive in character, it being understood that only the preferred embodiment has been shown and described fully and that all changes and modifications that come within the spirit of the invention are desired to be protected.

Having thus described the present invention, what is claimed is:

1. An electron pump comprising:

(a) an inner housing formed of a metallic alloy, the inner housing having an inner chamber therein, the inner chamber having therein:
  (1) a metallic rod centrally disposed therein;
  (2) a quartz crystal axially disposed around the rod, an electron flow being generated from the crystal;
  (3) a plurality of flash lamps disposed around the crystal; and
  (4) a plurality of reflectors surrounding the lamps;

(b) means for cooling surrounding the inner housing;

(c) an outer housing disposed around the means for cooling, the outer housing having an outer chamber therein, the outer chamber having coiled wire windings therein; and (d) a plurality of carbon brushes disposed proximate one end of the metallic rod, the brushes receiving the electron flow and creating an electric current therefrom.

2. The electron pump of claim 1, wherein the means for cooling comprises a plurality of cooling tubes, and further wherein the cooling tubes are filled with fluid.

3. The electron pump of claim 1, further comprising a computator attached to the metallic rod.

* * * * *